US005131924A

United States Patent [19]

Wiand

[11] Patent Number: 5,131,924

[45] Date of Patent: Jul. 21, 1992

[54] ABRASIVE SHEET AND METHOD

[76] Inventor: Ronald C. Wiand, 1494 Heatherwood, Troy, Mich. 48098

[21] Appl. No.: 474,373

[22] Filed: Feb. 2, 1990

[51] Int. Cl.[5] ..... B24D 11/00

[52] U.S. Cl. ..... 51/293; 51/295; 51/308; 51/309

[58] Field of Search ..... 51/293, 295, 308, 309

[56] References Cited

U.S. PATENT DOCUMENTS

| | | | |
|---|---|---|---|
| 2,201,196 | 5/1940 | Williamson | 51/278 |
| 2,876,086 | 3/1959 | Raymond | 51/298 |
| 3,860,400 | 1/1975 | Prowse et al. | 51/295 |
| 4,282,011 | 8/1981 | Terpay | 51/293 |
| 4,285,171 | 8/1981 | Block et al. | 51/293 |
| 4,668,248 | 5/1987 | Dettelbach et al. | 51/293 |
| 4,836,832 | 6/1989 | Tumey et al. | 51/295 |
| 4,925,457 | 5/1990 | deKok et al. | 51/295 |
| 4,964,884 | 10/1990 | Jürissen et al. | 51/293 |
| 4,974,373 | 12/1990 | Kawashima et al. | 51/295 |

*Primary Examiner*—William R. Dixon, Jr.
*Assistant Examiner*—Willie J. Thompson
*Attorney, Agent, or Firm*—Harness, Dickey & Pierce

[57] ABSTRACT

A method of manufacture of a durable abrasive sheet which includes a perforated metal sheet of woven metal mesh or the like having abrasive grit brazedly attached, imbedded in a backing substrate. The method includes the steps of coating a perforated metal substrate with a mixture of an infiltrant and a temporary binder and applying a layer of abrasive grit particles thereto. Thereafter, this product is heated to drive off the binder and attach the grit particles to the perforated metal substrate. The metal substrate having the grit particles attached is then imbedded in a backing substrate such that the portion of the perforated metal substrate having the grit particles attached are at the surface of the backing substrate. In order to provide a cutting type abrasive sheet material the particles are magnetically aligned on the perforated metal substrate and brazed in position. Thereafter, a deformable substrate sheet is placed contiguous with the perforated metal substrate. This combination is placed in a press having a deformable pressure plate which is deformable with respect to the grit material used such that when pressure is applied to imbed the metal substrate the grit particles extend into the deformable pressure plate to provide exposed portions of the grit particles in the final abrasive sheet. A metallized ceramic substrate having abrasive grit particles brazedly attached are also utilized for imbedment in a backing substrate.

60 Claims, 2 Drawing Sheets

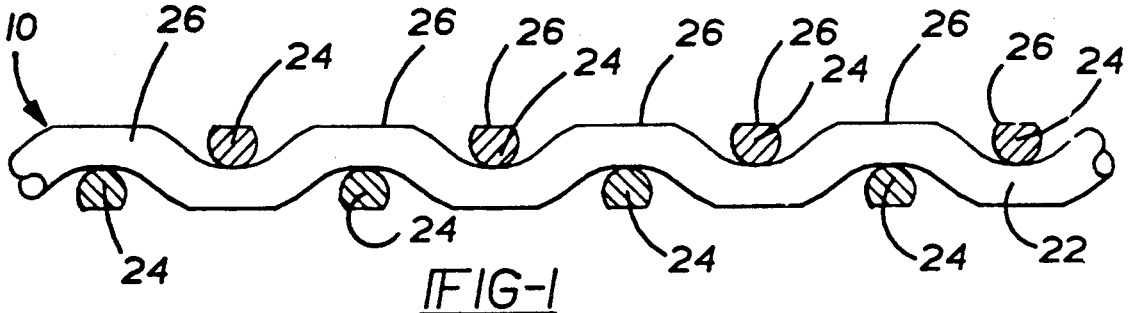
FIG-1
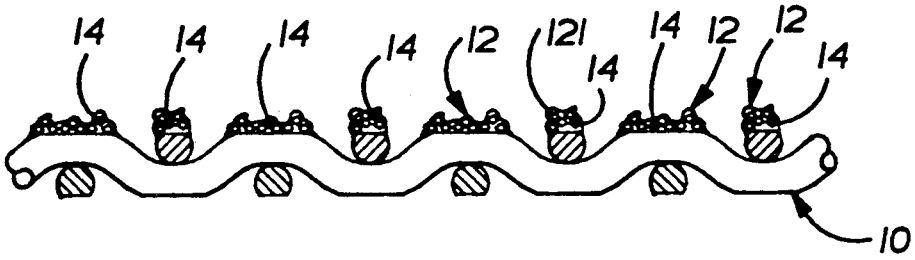
FIG-2
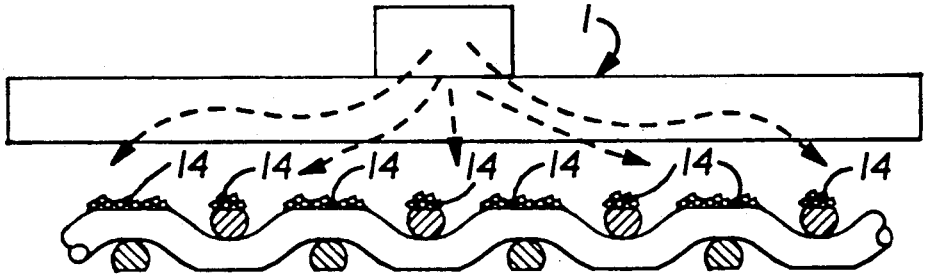
FIG-3
FIG-4
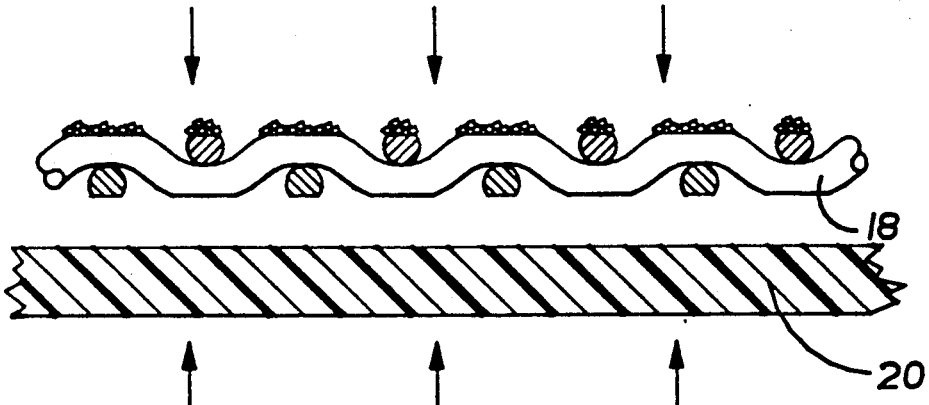
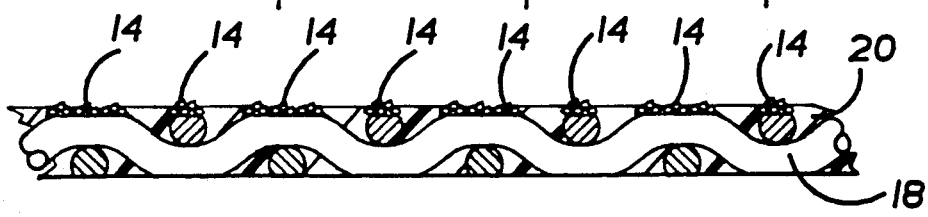
FIG-5

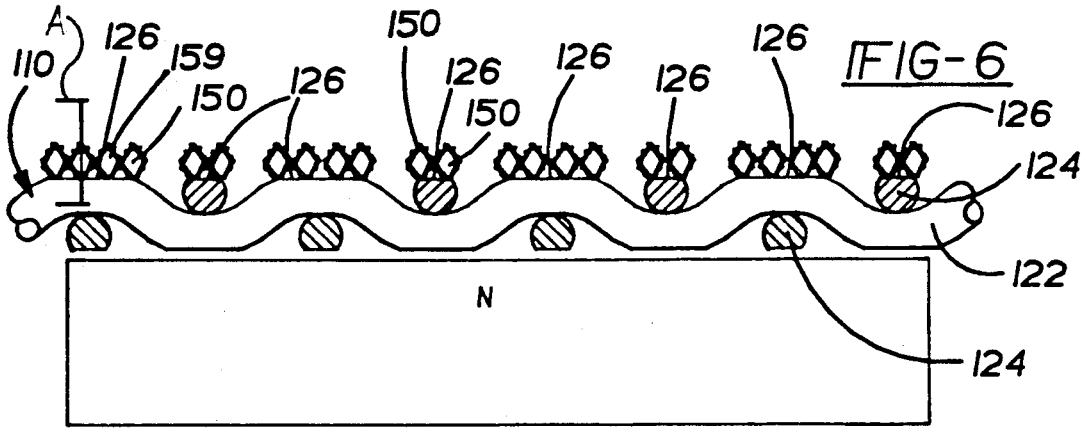
FIG-6
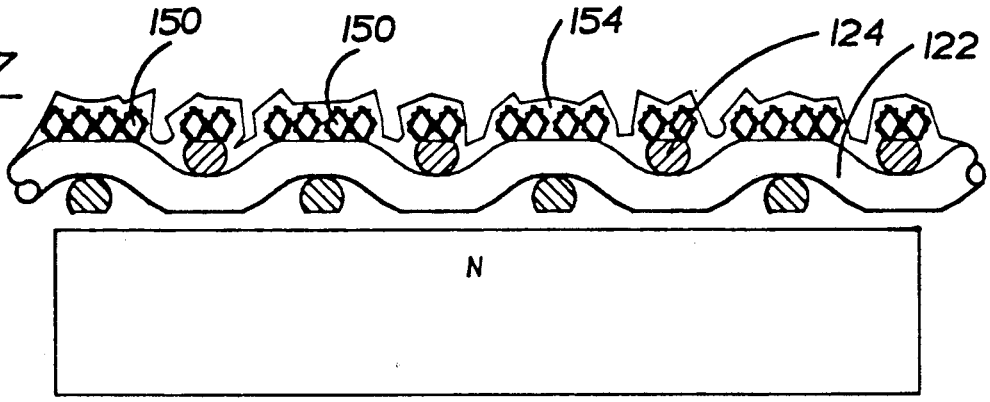
FIG-7
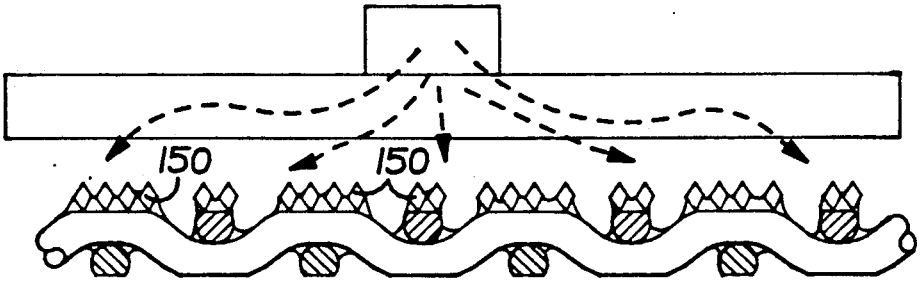
FIG-8
FIG-9
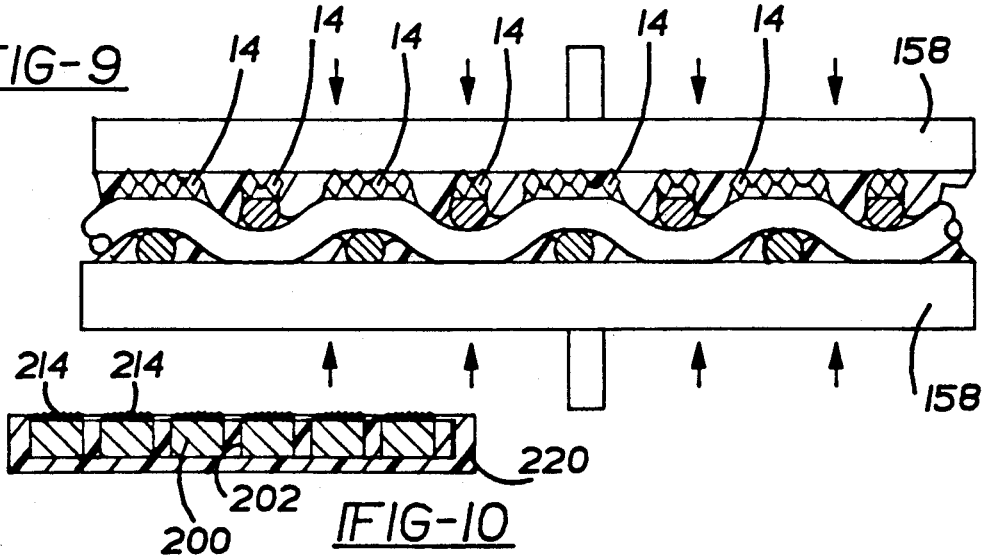
FIG-10

ABRASIVE SHEET AND METHOD

BACKGROUND OF THE INVENTION

The present invention relates to abrasive sheets and methods of producing abrasive sheets. More particularly, the present invention relates to flexible abrasive sheets for withstanding heavy usage in the abrasion of materials.

It has been a goal in the art to provide flexible abrasive sheets which have diamond-like hardness abrasive grit particles attached to discrete portions of the sheets. While many such constructions have been attempted in the past the resulting abrasive sheet materials were generally lacking in their durability in that particles were easily disattached during use, thereby rendering the abrasive sheet unsuitable for some uses. It has also been a goal to provide abrasive sheets which include discrete patterns or areas where abrasive grits are attached while leaving other areas open and without abrasive grits. It has also been a goal in the art to provide structures wherein portions of the abrasive grit particles remain exposed after formulation of the abrasive sheet to provide a biting or cutting type structure.

A flexible abrasive sheet is shown in U.S. Pat. No. 3,860,400 to Prowse et al. In this patent an abrasive sheet is disclosed wherein a perforated sheet material or mesh material is imbedded in a non-conductive backing substrate such that portions of the sheet or mesh extend from the substrate. Thereafter the grit particles are electroplated onto the extending areas to provide the final abrasive grit structure. While this abrasive sheet provides an advantageous construction because the abrasive grit particles are attached by electroplating, the durability of the article is still limited as to an electroplated structure.

It is therefore an object of the present invention to provide an abrasive sheet which is more durable than the prior constructions.

It is a further object of the present invention to provide a cutting type abrasive sheet.

It is still further an object of the present invention to provide improved methods of formulating abrasive sheets to produce an abrasive sheet in accordance with the above objects.

SUMMARY OF THE INVENTION

In accordance with these goals and objectives, the present invention provides an improved structure whereby an abrasive sheet can be provided with superior durability characteristics in that the abrasive grit particles are brazedly attached to a mesh or sheet substrate with spaced apertures therethrough and having at least a layer of a metal material which will allow a braze material to stick to the metal material. This gives the abrasive sheet of the present invention the advantage of providing a coated or backed abrasive sheet with the abrasive grit particles securely held in position on the sheet substrate with a braze material to provide secure attachment and durability to the sheet. Additionally, in the present invention there is provided a method of making a "cutting type" abrasive sheet whereby exposed portions of the abrasive grit particles are facilitated to provide extra cutting area while still giving secure attachment to the particles.

Thus, according to the present invention, there is provided an abrasive sheet which includes a backing substrate with a sheet element having at least a layer of a metal material thereon which is imbedded in the backing substrate at the surface thereof. The sheet element includes a plurality of apertures therein and has an abrasive grit particulate material which is brazed onto the metal layer of the sheet.

Also, in accordance with the present invention, there is provided a method of manufacture of an abrasive sheet which includes the steps of first providing a substrate having a plurality of apertures therein and having a metal surface which is compatible for brazing onto the surface and coating the metal surface with a mixture of an infiltrant and a tacky temporary binder. Next, a layer of grit particles is sprinkled onto the tacky coating and is thereafter heated to attach the grit particles to the substrate. The brazed substrate is then imbedded in a backing material. This produces a product which has a perforated sheet portion with grit particles brazedly attached thereto in discrete areas at the surface of the backing substrate.

Additional benefits and advantages of the present invention will become apparent from the subsequent description of the preferred embodiments and the appended claims taken in conjunction with the accompanying drawings.

BRIEF DESCRIPTION OF THE DRAWINGS

FIG. 1 is a cross-sectional view of a mesh substrate prepared in accordance with the teachings of the present invention;

FIG. 2 is a cross-sectional view of the mesh substrate of FIG. 1 having a coating of brazing material, grit particles and a temporary binder for adhering the grit particles to the flat surface areas of the prepared mesh material;

FIG. 3 is a cross-sectional view showing schematically the application of heat to the combination of FIG. 2 for brazing of the abrasive grit particles to the flat surfaces of the mesh;

FIG. 4 is a cross-sectional view showing the placement of a backing substrate sheet material for preparation for imbedding the brazed mesh element of FIG. 3 in the substrate material;

FIG. 5 is a cross-sectional view showing the completed abrasive sheet made in accordance with the teachings of the present invention;

FIG. 6 is a cross-sectional view showing the alignment of magnetically interactive particles on the flattened surfaces of the mesh material;

FIG. 7 is a cross-sectional view showing a temporary binder coating for temporarily adhering the magnetically aligned particles in the aligned position on the mesh substrate;

FIG. 8 is a cross-sectional view showing schematically the application of heat to the combination of FIG. 7 for brazing of the particles onto the substrate;

FIG. 9 is a cross-sectional view showing schematically the application of pressure for imbedding the combination of FIG. 8 in a backing sheet such that portions of the abrasive grit particles are exposed in the final structure; and FIG. 10 is a cross-sectional view of a perforated sheet abrasive structure made in accordance with the teachings of the present invention.

DESCRIPTION OF THE PREFERRED EMBODIMENTS

Referring now to the drawings, a method of manufacturing a novel abrasive sheet structure is provided having the steps of first providing a substrate 10 having a plurality of apertures therein. The substrate 10 has at least a metal surface, such as a metal layer which is compatible with a brazing compound, for brazedly attaching a grit material to the surface of substrate 10. In a preferred embodiment the substrate is a metal substrate. The metal substrate 10 is then coated with a mixture of a braze and a tacky temporary binder 12. A layer of grit particles is then sprinkled onto the coating or in the alternative is employed in the coating of the above step for temporarily adhering the particles to the braze material. Thereafter, the product having the braze material and grit particles temporarily adhered thereto is heated by placement in an oven 16 and heating to cause the temporary binder to be driven off, and the braze to infiltrate the abrasive grit for adhering the abrasive grit onto the metal substrate 10 as shown in FIG. 3. Thereafter, the product is then imbedded in a backing substrate by applying the backing substrate as shown in FIG. 4. The final product, shown in FIG. 5, includes a backing substrate material 20 in which a metal substrate 10 is imbedded in the backing substrate 20 at the surface thereof.

The metal substrate 10 has the abrasive grit material 14 brazedly attached thereto. The metal sheet used can be flexible or rigid and can be any number of metal materials such as titanium, chromium, brass, aluminum, steel, iron, copper, gold, silver or other substrates wherein a brazing material can be utilized to brazingly attach the grit particles. Similarly, mesh or screen type substrates made of the same or similar materials can be utilized in the present invention.

A novel and improved screen type of material is provided in the present invention whereby a series of discrete flat surfaces 26 are facilitated for purposes of attaching the abrasive grit particles. These discrete "cutting" areas are preferable in many abrasive grit structures.

A mesh material having flattened portions at the intersections between warps 22 and woofs 24 of a woven screen-like mesh material are provided by placing the screen between a set of plates in a press or the like, and applying a pressure sufficient to flatten these areas to the extent desired. Such a configuration provides advantageous flat portions 26 on which an abrasive grit material may be attached. The size of the flattened portions may be adjusted according to the amount of pressure used in the step of flattening these areas.

This provides a final construction whereby a large surface area of abrasive grit containing areas is provided on the completed abrasive sheet and utilizes a flattened area to provide the abrasion. Thus, such a structure provides for an advantageous attachment of these particles to provide a substantially co-planar coating of abrasive grit particles.

In an alternate embodiment the substrate could be of a suitable material which has a metal layer deposited thereon which would retain its structural integrity at a brazing temperature. Such suitable materials include ceramics, carbon and carbon fiber materials. In a preferred embodiment, a woven ceramic screen, such as made out of an alumina ceramic fiber material, could be utilized as a suitable mesh material. This is accomplished by the addition of a layer of titanium, chromium, gold, silver, iron, copper, aluminum, brass, metal or metal-like materials to which the braze will adhere on the surface of the ceramic mesh. Such a layer can advantageously be provided by the use of vapor deposition or electrodeless deposition technologies which are commonly available today. In the case of a carbon substrate electrodeposition of the metal layer could be accomplished. Such a layer would provide a surface on which abrasive grit particles could be brazed to a ceramic substrate. This structure allows for a brazed grit holding power and tenacity, while retaining the advantageous characteristics of a ceramic material, such as heat dissipation and insulating characteristics.

Similarly, a ceramic sheet substrate could be utilized in the process and products of the present invention. Accordingly, a ceramic sheet substrate of an alumina material or the like could be provided of a suitable shape and with a plurality of apertures. The ceramic sheet useful in the present invention has a surface layer of a metal material, such as titanium or chromium, which is vapor deposited thereon and is compatible with the braze material to be used. Such a layer provides a suitable attachment point for brazing of abrasive grit particles on the substrate.

The infiltrant and binder materials used herein are similar to those set forth in my co-pending application Ser. No. 310,783 entitled "A Multi-layer Abrading Tool and Process" filed on Feb. 14, 1988 which is hereby incorporated herein by reference.

Suitable binders useful herein are temporary in that they temporarily adhere the infiltrant and the abrasive grit particles to the flat portions 26 prior to the heating step for infiltrating the abrasive grits and attaching them to the flat portions of the metal sheet element 10. Suitable binders may include acrylic resins, methylacrylate resins, lacquers, paints, urethanes and the like. Other suitable binders could include water/flour or water/-sawdust binders which may produce desirable effects in the final abrasive matrix coating. A particularly preferred temporary binder includes a Wall Colmonoy "type S" viscous water soluble urethane cement. Other suitable binders may be used, however, the binder must be one such that it can be readily driven off through heat or other means prior to heating the substrate for allowing the braze to attach the abrasive grit particles to the underlying perforated sheet metal element 10.

The braze used may be of any of the long wearing brazing materials known in the art, such as nickel chromium brazing powders and the like. Particularly, preferred infiltrant materials include the Wall Colmonoy L. M. 10 Nicrobraz® material containing 7.0% chromium, 3.1% boron, 4.5% silicon, 3.0% iron and the balance nickel; however, other brazing type infiltrants may be used as is known to those skilled in the art. The braze step has the further advantage of brazing the mesh structure together at the intersections between the woofs and the warps to provide a much stronger and more durable mesh structure than the prior art screen type abrasive sheet structures.

The backing substrate may be provided by any of a number of means such as spray coating, extrusion, injection molding and the like of suitable materials. Suitable backing materials include polymeric type materials. In a preferred embodiment of the backing material is a flexible type material such as an elastomer. Particularly suitable polymeric materials include synthetic plastics, rubbers and latexes. Preferred materials include polypropylenes, acrylic butydienes (ABS), styrene acrylic nitrides, nylons, methylmethacrylate resins, polyethylenes, epoxies, fiberglass or other resin compositions. It is preferable that the material selected for use in the methods herein is at least pressure deformable and preferably a thermoformable material such that it can be formed with heat or with pressure alone into the apertures in the sheet substrate used. The backing substrate may be applied to the side 18 opposite to that on which the abrasive grit surface has been added to the perforated sheet. In a preferred embodiment of the invention this backing substrate may be applied by placing a pressure and heat deformable backing substrate sheet over the brazed perforated metal sheet on the side containing the abrasive grit particles. This combination is placed in a press having facing planar surfaces. Heat and pressure is applied for deforming the backing material and forcing it into the perforations thereby imbedding the perforated sheet into the polymer material (as shown in FIG. 5) such that the perforated sheet substrate is at the surface of the backing sheet.

Abrasive grit particles suitable for use in the present invention include abrasive grit particles commonly used in abrasive grit structures, which are brazeable in suitable braze matrix. Preferably, the diamond-like hardness abrasive grits such as tungsten carbide, cubic boron nitrite, and diamond grit particles are utilized in the present invention.

Referring now to FIGS. 6 through 9 there is provided a method for producing a cutting type abrasive grit structure whereby portions of the abrasive grit particles extend from the structure to provide a cutting type structure in an abrasive sheet.

In this alternate embodiment magnetically interactive grit particles 150 are placed on the flattened surfaces of the prepared screen substrate 110. A magnet 152 is provided and is placed underneath the substrate 110 with a single pole of the magnet, the north pole is shown, facing the substrate structure. This aligns the magnetic interactive particles such that an axis (A) passing through their greatest length is substantially perpendicular to the plane of the substrate material, i.e., surfaces 126. Thereafter, a temporary binder coating 154 is applied to temporarily hold the particles in this aligned position. Thereafter, a brazing material may be applied to the coated particles and the product would be heated to braze the grit particles onto the substrate. As shown in FIG. 9, the product is imbedded in a backing sheet with cutting portions of the grit particles exposed by placing the backing sheet underneath the brazed product in a heated platen press.

A special press arrangement is used in this embodiment wherein a first upper pressure plate 158 and a second lower pressure plate 158 are provided such as by using a heated platen press. Upper pressure plate 158 is made or lined with a material which is conformable with respect to the particular grit particles being used such that when pressure is applied the grit particles partially imbed themselves into the upper pressure plate 158. Pressure plate 156 is substantially nonconformable such that the grit particles only extend into plate 158 during the final imbedding step. Suitable magnetically interactive particles include ferric oxide, diamond coated with ferric oxide and tungsten carbide. Preferably, particles such as diamonds may be made magnetically interactive by coating the particles with an iron powder.

Suitable materials from which the conformable plate 158 may be constructed include materials such as graphite, polypropylene, polyethylene, cardboard, aluminum foil coated cardboard or a REEMAY® cloth type material or the like. In a preferred embodiment a plate suitable for use in the present invention utilizes a sheet of a polyethylene material attached to the upper plate 158 of a heated platen press.

In a preferred embodiment a release agent is utilized between the conformable upper plate 158 and the brazed diamond abrasive sheet. Such a release agent will provide for ease of separation between the conformable plate and the coated abrasive sheet. Suitable release agents include silicon coatings and the like. A preferred release agent is a silicon coated release sheet such as that used as a backing for adhesive stickers and the like. Such a release sheet can be interposed with the silicon side facing the diamond abrasive. It has been found that utilizing such a release sheet allows the extruded polypropylene material to flow between the diamond particles and under the release sheet to provide a substantially even surface therebetween. This is advantageous in an abrasive sheet construction since concavities in such a structure will collect undesirable debris which could damage a work surface when using the abrasive sheet.

FIG. 10 shows an alternate embodiment of the structure herein where a perforated thin sheet 200 is provided having apertures 202 therein. In this embodiment the sheet material 200 is imbedded in the backing sheet material similarly as that shown above with the backing material flowing into the apertures in the sheet thereby providing a further abrasive sheet construction. This embodiment provides the advantage of utilizing a brazed type bonded abrasive grit structure for durability while providing a flexible durable backing member.

A "cutting" type abrasive sheet may also be formulated and is beneficial without the step of magnetically aligning particles. Thus, in this alternate embodiment a suitable grit material is brazed onto a perforated substrate and the brazed grit side is placed in a heated platen press with the release agent and conformable sheet adjacent the grit side. The sheet is thereafter imbedded into a backing substrate as disclosed above, to form a "cutting" type abrasive sheet.

Further understanding of the present invention will be had by reference to the following examples which are presented herein for purposes of illustration but not limitation.

EXAMPLE I

A flexible abrasive sheet was prepared as follows.

A 12 metal mesh screen having 0.028 diameter wire was provided. The mesh screen was placed in an oven at a temperature of 800° F. for about two minutes to decompose protective any coating or corrosion resistant treatment on the wire.

A 12"×12" square of the above screen was pressed between flat parallel plates at 50 tons pressure to produce flats, all in the same plane, on the wire mesh at the intersection of the woofs and the warps of the mesh.

A roller applicator was used to coat the flats of the wire mesh with a braze paste of 80% Wall Colmonoy L. M. No. 10 Microbrazing powder -325 mesh particle size mixed with 3% iron powder (4–6 micron), 10% Molybdenum powder (10 micron) and "type S" cement.

A coating of 40/50 diamond grit was sprinkled onto the paste covered flat surfaces.

The substrate was then placed in vacuum furnace and held at a vacuum of $10^{-5}$ torr. The oven was heated first at a temperature of about 800° F. for 15 minutes and thereafter the temperature was raised to a temperature of about 1890° F. for about 3.25 minutes.

Thereafter the brazed sheet was placed diamond side up onto a 12"×12" sheet of polypropylene in a heated platen press and was thereafter pressed under 10 tons of pressure at 350° F. for 30 seconds.

The screen was found to be imbedded in the plastic sheet with the flat areas containing the brazed grit coating at the surface of the plastic sheet. The resulting sheet was found to produce a flexible, strong, wear resistant, non loading and fast cutting abrading sheet.

EXAMPLE II

A "cutting" type abrasive sheet is prepared as follows.

A 12 mesh screen substrate having flattened surfaces at the intersections between the woofs and warps is prepared as set forth in Example I.

Diamond particles coated with iron oxide of a 40/50 size are sprinkled onto the flattened areas.

A pole of a magnet is placed adjacent the underside of the structure to align the particles such that an axis passed through their longest dimension is substantially perpendicular to the plane of the flattened surfaces. A coating of thinned "S" type cement is sprayed on the aligned particles to temporarily adhere the particles in the aligned position on the flattened areas. The cement is allowed to cure and the magnet is removed. A coating of 80% Wall Colmonoy L. M. No. 10 brazing powder -325 mesh particle mixed with 3% iron powder (4–6 micron) and 10% Molybdenum powder (10 micron) is sprinkled on the surface and thereafter the product is heated as set forth in Example I.

A product is produced having the particles brazed onto the substrate in the aligned configuration. The brazed structure is placed on top of a 12"×12" polypropylene sheet. On top of the diamond side of the brazed mesh is placed a silicon coated release sheet, such as that commonly used for backing of adhesive stickers, with the release side facing the diamond particles. On top of the release sheet is placed a plate made out of a polyethylene material which is deformable with respect to the diamond grit particles. Thereafter the assembly is subjected to 10 tons of pressure at 350° F. The brazed substrate is found to be imbedded in the plastic sheet with edges of the grit particles exposed to provide a cutting type abrasive sheet.

EXAMPLE III

A "cutting" type abrasive sheet was prepared as follows.

A 0.0315" thick steel sheet was perforated with 3/32" holes on a 60 degree stagger between 3/10" center 33 holes/in$^2$ providing a perforated steel sheet with 37% surface area and 63% open area. The sheet was cut to a 4¾" disc shape and -325 mesh particle size, Wall Colmonoy L. M. No. 10; 3% iron powder in the 4–6 micron range; 10% Molybdenum powder in the 10 micron range and Wall Colmonoy "type S" cement.

80/100 diamond was then sprinkled onto the coated surfaces of the steel sheet. This coated product was then placed in a vacuum furnace at a vacuum of $10^{-5}$ torr The oven was heated first at a temperature of about 800° F. for 15 minutes and thereafter the temperature was raised to 1740° F. for about 5 minutes for brazing the diamonds onto the substrate.

Thereafter, the brazed sheet was placed (diamond grit face up) on a four thousandths of an inch polypropylene sheet. A silicon release sheet such as that of Example II was placed silicon side down on top of the brazed diamond surface. A polyethylene sheet was placed on top of the release sheet. The brazed sheet so prepared was placed in a heated platen press and pressed under 10 tons of pressure at 350° F. for 30 seconds. During this pressing the diamond particles partially imbed in the release sheet and polyethylene sheet and the polypropylene was extruded through the holes in the metal sheet and under the silicon release sheet to coat and imbed the metal sheet in the polypropylene.

The product was removed from the platen press and the cutting edges of the diamond particles were exposed. A substantially flat coating of polypropylene was found between the diamond particles. The steel substrate was imbedded in the polypropylene sheet.

EXAMPLE IV

An abrasive sheet is prepared as follows.

A mesh of woven alumina fibers with a vapor deposited film of titanium on its surface is cut to a disc shape. The titanium side of the mesh is coated with a braze paste which includes: 80% -325 mesh particle size, Wall Colmonoy L. M. No. 10; 3% iron powder in the 4–6 micron range; 10% Molybdenum powder in the 10 micron range and Wall Colmonoy "type S" cement.

80/100 diamond is then sprinkled onto the coated surfaces of the mesh. This product is then placed in a vacuum furnace at a vacuum of $10^{-5}$ torr, then is heated first to a temperature of about 800° F. for 15 minutes and thereafter the temperature is raised to 1740° F. for 5 minutes for brazing the diamonds onto the titanium layer of mesh substrate.

Thereafter, the brazed mesh is placed diamond side up on to a sheet of polypropylene, which combination is heated at a temperature of 350° F. under 10 tons of pressure in a platen press for 30 seconds.

The mesh is found to be imbedded in the polypropylene sheet with abrasive grit at the surface at discretely spaced intervals. A strong, wear resistant non-loading fast cutting abrading sheet is formed.

EXAMPLE V

An abrasive sheet is prepared as follows.

A perforated ceramic sheet of alumina with a vapor deposited film of titanium on its surface is cut to a disc shape. The titanium side of the perforated ceramic sheet is coated with a braze paste which includes: 80% -325 perforated ceramic sheet particles size, Wall Colmonoy L. M. No. 10; 3% iron powder in the 4–6 micron range; 10% Molybdenum powder in the 10 micron range and Wall Colmonoy "type S" cement.

80/100 diamond is then sprinkled onto the coated surfaces of the perforated ceramic sheet. This product is then placed in a vacuum furnace at a vacuum of $10^{-5}$ torr, then is heated first to a temperature of about 800° F. for 15 minutes and thereafter the temperature is raised to 1740° F. for 5 minutes for brazing the diamonds onto the titanium layer of perforated ceramic sheet substrate.

Thereafter, the brazed perforated ceramic sheet is placed diamond side up on to a sheet of polypropylene, which combination is heated at a temperature of 350° F.

under 10 tons of pressure in a platen press for a period of 30 seconds.

The perforated ceramic sheet is found to be imbedded in the polypropylene sheet with abrasive grit at the surface at discretely spaced intervals. A strong, wear resistant non-loading fast cutting abrading sheet is formed.

While the above description constitutes the preferred embodiments of the present invention, it is to be appreciated that the invention is susceptible to modification, variation and change without departing from the proper scope and fair meaning of the accompanying claims.

What is claimed is:

1. A method of manufacture of an abrasive sheet comprising the steps of:

(a) providing a sheet substrate having a plurality of spaced apertures therethrough, said sheet substrate including at least a metallic surface layer;

(b) coating said sheet substrate with a mixture of a braze and a temporary binder;

(c) applying a layer of grit particles onto the coating of step (b);

(d) heating the product of step (c) to drive off the binder and attach by brazing said grit particles to said metallic layer of said sheet substrate; and (e) imbedding the product of step (d) in a backing substrate such that the portions of the sheet substrate having the grit particles attached are substantially at the surface of said backing substrate.

2. The method according to claim 1 wherein the product of step (d) is imbedded in the backing substrate by placing a pressure and heat deformable polymer substrate sheet contiguous with the product of step (d) in a press having facing planar surfaces and applying heat and pressure for deforming the polymer material and forcing it into the plurality of spaced apertures.

3. The method according to claim 1 wherein said sheet substrate further comprises a woven mesh material with increased area flattened surface portions at the intersections between the warps and the woofs.

4. The method according to claim 1 wherein said sheet substrate is a perforated metal sheet.

5. The method according to claim 1 wherein said sheet substrate is a metal coated ceramic substrate.

6. The method according to claim 5 wherein said metal coated ceramic substrate is a mesh material woven from a ceramic fiber material.

7. The method according to claim 6 wherein siad ceramic fiber material is alumina strands.

8. The method according to claim 5 wherein said sheet substrate is a perforated metal coated ceramic sheet.

9. A method of manufacturing an abrasive sheet comprising the steps of:

a) providing a metallic woven screen material;

b) flattening the outer surface at intersections of the warps and woofs of the screen on at least one side of the screen to provide a plurality of flattened areas on said screen at said intersections;

c) applying a matrix coating to the plurality of flattened areas, said matrix coating comprising a temporary binder, a braze and an abrasive grit material;

d) heating the product of step (c) to drive off the temporary binder for allowing said brazing material infiltrant to attach said abrasive grit material to said flattened areas of said screen; and e) imbedding the product of step (d) in a backing substrate.

10. The method of claim 9 wherein the product of step (d) is imbedded in the backing substrate by placing a pressure and heat deformable polymer substrate sheet contiguous with the product of step (d) in a press having facing planar surfaces and applying heat and pressure for deforming the polymer material and forcing it into the perforations.

11. A method of manufacture of a cutting type abrasive sheet having abrasive grit particles with exposed cutting edges extending from the abrasive sheet, said method comprising the steps of:

(a) providing a sheet substrate including a plurality of spaced apertures therethrough, said sheet substrate including at least a metal surface layer;

(b) applying magnetically interactive grit particles onto the surface layer of the sheet substrate and magnetically aligning the grit particles onto the sheet substrate;

(c) attaching the particles to the sheet substrate in the magnetically aligned position with a braze composition;

(d) imbedding the product of step (c) in a backing material wherein cutting portions of the grit particles are exposed by disposing the product of step (c) and a pressure deformable backing sheet material contiguous with the sheet substrate between an upper and lower pressure plate, wherein at least one of said upper or lower pressure plates is conformable with respect to the grit material used and said one pressure plate is contiguous with a side of the substrate having the grit affixed thereto; and (e) applying pressure to said upper and lower plates for pressurizing said backing material into the perforations and imbedding at least a portion of said grit particles into said one of said upper or lower pressure plates.

12. The method according to claim 11 wherein said sheet substrate is a perforated metal sheet.

13. The method according to claim 11 wherein said sheet substrate is a metal mesh material with flattened areas at the intersections between the woofs and warps.

14. The method according to claim 11 wherein said sheet substrate is a ceramic substrate with a metallized layer on the surface thereof for brazedly attaching the abrasive grit particles.

15. The method according to claim 11 wherein said sheet substrate is a ceramic woven mesh substrate having a metallized surface layer.

16. A method of manufacture of a cutting type abrasive sheet having abrasive grit particles with exposed cutting edges extending from the abrasive sheet, said method comprising the steps of:

(a) providing a sheet substrate having a plurality of apertures therethrough, said sheet substrate having at least a metal surface layer;

(b) placing a pole of a magnet adjacent the lower surface of said substrate;

(c) sprinkling magnetically interactive grit particles onto said substrate, said pole of said magnet acting to align the particles such that an axis through the longest axial dimension of the particles is substantially perpendicular to the plane of said sheet substrate;

(d) temporarily affixing the particles in the aligned position on the substrate with a temporary binder material and allowing the binder to cure to the extent that the particles retain the aligned position when the magnet is removed;

(e) applying a braze material over the binder coating of step (d) and heating this product to braze the grit particles to the substrate in the aligned position;

(f) imbedding the product of step (e) in a backing substrate wherein cutting portions of the grit particles are exposed by disposing the product of step (e) and a pressure deformable backing material contiguous with the sheet substrate between an upper and lower pressure plate, wherein at least one of said upper or lower pressure plates is conformable with respect to the grit material used and said one pressure plate is contiguous with a side of the substrate having the grit affixed thereto; and (g) applying pressure to said upper and lower plates for pressurizing said backing sheet material into the perforations and imbedding at least a portion of said grit particles into said one of said upper or lower pressure plates.

17. The method according to claim 16 wherein said sheet substrate is a perforated metal sheet.

18. The method according to claim 16 wherein said sheet substrate is a metal mesh material with flattened areas at the intersections between the woofs and warps.

19. The method according to claim 16 wherein said sheet substrate is a ceramic substrate with a metallized layer on the surface thereof for brazedly attaching the abrasive grit particles.

20. The method according to claim 16 wherein said sheet substrate is a ceramic woven mesh substrate having a metallized surface layer.

21. A method of manufacture of a cutting type abrasive sheet having abrasive grit with exposed cutting edges; comprising the steps of:

(a) providing a mesh substrate having flattened portions at the intersections of the warps and woofs on at least a first side thereof, said mesh substrate including at least a metal surface on at least said flattened portions;

(b) providing a magnetically interactive abrasive grit material comprising a plurality of particles and sprinkling said magnetically interactive abrasive grit material on said flattened portions of said mesh substrate;

(c) aligning said particles on said flattened portions such that an axis passed through the longest axial dimension of said particles is substantially perpendicular to the plane of the flattened portions by placing a pole of a magnet adjacent and below the mesh substrate;

(d) temporarily affixing the particles in the aligned position by coating the particles on the mesh substrate with a temporary binder material and allowing the binder material to cure to the extent that the particles retain the aligned position when the magnet is removed;

(e) applying a braze material over the product of step (d) and heating of this product to braze the grit particles in the aligned position to said flattened portions of said mesh substrate;

(f) providing a pressure plate member which is conformable with respect to the grit material when pressure is applied;

(g) imbedding the product of step (e) in a backing material, wherein cutting portions of the grit particles are exposed, by disposing the product of step (e), with a pressure conformable backing sheet contiguous therewith, between the pressure plate of step (f) and a second non-conforming pressure plate, with the side of the product having the grit material contiguous with the conformable pressure plate and the pressure conformable backing material being contiguous with the second non-conforming pressure plate; and (h) pressurizing the product of step (e) and the underlying pressure conformable backing sheet for imbedment of said mesh into said pressure conformable backing material and for imbedding at least a portion of said grit material into said conformble pressure plate.

22. The method according to claim 21 wherein said mesh substrate is a metal mesh material.

23. The method according to claim 21 wherein said mesh material is a woven ceramic fiber material.

24. A method of manufacturing an abrasive sheet comprising the steps of:

(a) providing a sheet substrate having a plurality of spaced apertures therethrough, said sheet substrate having at least a metal surface thereon;

(b) brazing an abrasive grit material on said metal surface of the sheet substrate;

(c) providing a pressure extrusion device having a first platen which is deformable with respect to the abrasive grit material and a second platen for pressuring the sheet substrate therebetween;

(d) providing a pressure extrudable material and placing said pressure extrudable material contiguous with the sheet substrate in said pressure extrusion device; and (e) applying pressure to the components of step d for imbedding the abrasive coated metal sheet substrate in the pressure extrudable material wherein portions of said abrasive grit material deform into said first platen and are protected from the pressure extrudable material while the sheet substrate is imbedded in the pressure extrudable material such that cutting edges of said abrasive grit are left exposed in the resulting abrasive sheet structure.

25. The method of claim 24 wherein heat and pressure are used to extrude the pressure extrudable material onto the sheet substrate.

26. The method according to claim 24 wherein the pressure extrudable material is selected from the group consisting of polypropylenes, acrylic butydienes, styrenes, acrylic nitrides, nylons, methylmethacrylate resins, polyethylenes, uncured epoxy compositions and fiberglass.

27. The method according to claim 24 wherein the particles of the abrasive grit are aligned with their longest axis perpendicular to the metal sheet substrate.

28. The method according to claim 24 wherein a release agent is interposed between said first platen and said sheet substrate for providing release from said first platen.

29. The method according to claim 24 wherein said release agent is a silicon coated release sheet.

30. The method according to claim 24 wherein said sheet substrate is a perforated metal sheet.

31. The method according to claim 24 wherein said sheet substrate is a mesh material.

32. The method according to claim 31 wherein said mesh material is a wire mesh material.

33. The method according to claim 32 wherein the wire mesh material is woven and has flattened areas at the intersections between the woofs and warps wherein abrasive grit is brazedly attached.

34. The method according to claim 24 wherein said sheet material is a ceramic sheet with a metallized outer surface.

35. The method according to claim 24 wherein said sheet material is a woven ceramic mesh material having a metallized outer layer.

36. An abrasive sheet comprising:

a backing substrate;

a sheet element including a metal outermost facing surface having a plurality of apertures therethrough imbedded in said backing substrate at the surface thereof; and an abrasive grit material brazedly attached to the metal surface on the outermost facing surface of said sheet element.

37. The abrasive sheet according to claim 36 wherein said sheet element is a perforated metal sheet.

38. The abrasive sheet according to claim 36 wherein said sheet element is a metal mesh material.

39. The abrasive sheet according to claim 36 wherein said sheet element is a ceramic substrate with a layer of a metal thereon for allowing attachment of said abrasive grit by brazing thereto.

40. The abrasive sheet according to claim 36 wherein said sheet element is a woven ceramic material with a metallized layer for attachment of the abrasive grit.

41. An abrasive sheet comprising:

a backing substrate; a mesh material imbedded in said backing substrate, said mesh material including flattened portions at the intersections of the woofs and warps of said mesh on at least one side thereof, said flattened portions having a metal surface thereon for attachment of a braze material, said flattened portions being substantially co-planar with an outer surface of said backing substrate and at least a monolayer of abrasive grit particles attached to said flattened portions by a braze matrix.

42. The abrasive sheet according to claim 41 wherein said mesh material is a metal mesh material.

43. The abrasive sheet according to claim 41 wherein said mesh material is a woven ceramic mesh.

44. An abrasive sheet comprising:

a backing substrate; a sheet substrate having a plurality of apertures therethrough and a metal surface thereon imbedded in said substrate; an abrasive grit material comprising magnetically interactive particles brazedly attached to said sheet substrate such that an axis passed through the longest axis of the particles is substantially perpendicular to the metal surface of said sheet substrate, wherein at least portions of the grit particles extend outward from said backing substrate and are substantially uncoated by said backing substrate.

45. The abrasive sheet according to claim 44 wherein said sheet material further comprises a mesh material including flattened portions at the intersections of the woofs and warps of the mesh material, said particles being brazedly attached to said flattened portions.

46. The abrasive sheet according to claim 44 wherein said mesh material is a metal mesh material.

47. The abrasive sheet according to claim 44 wherein said mesh material is a woven ceramic mesh.

48. The abrasive sheet according to claim 44 wherein said sheet substrate is a perforated metal sheet.

49. The abrasive sheet according to claim 44 wherein said sheet substrate is a metal mesh material.

50. The abrasive sheet according to claim 44 wherein said sheet substrate is a ceramic substrate with a layer of a metal thereon for allowing attachment of said abrasive grit by brazing thereto.

51. The abrasive sheet according to claim 44 wherein said sheet substrate is a woven ceramic material with a metallized layer for attachment of the abrasive grit.

52. An abrasive sheet comprising a backing substrate; a metal sheet material having a plurality of apertures therethrough imbedded in said backing substrate at the surface thereof; and at least a monolayer of abrasive grit particles brazedly attached to said metal sheet material, wherein portions of said abrasive grit particles extend from said backing substrate and are substantially uncovered by the backing substrate.

53. The abrasive sheet according to claim 52 wherein said metal sheet material further comprises a woven mesh material having flattened portions at the intersections of the woofs and warps of the mesh, and said abrasive grit particles are brazedly attached at said flattened portions.

54. The abrasive sheet according to claim 52 wherein the longest axis of the abrasive grit particles is substantially perpendicular to the flattened portions.

55. An abrasive sheet comprising a backing substrate; a ceramic substrate having a plurality of apertures therethrough imbedded in said backing substrate at the surface thereof, said ceramic substrate having a metal surface adjacent the surface of the backing substrate, and an abrasive grit material brazedly attached to said metal surface.

56. The abrasive sheet according to claim 55 wherein said ceramic substrate is a ceramic woven mesh material.

57. A method of manufacture of an abrasive sheet comprising:

(a) providing a sheet substrate having a plurality of spaced apertures therethrough, said sustrate including at least a metallic surface layer;

(b) coating said sheet substrate with a mixture of a braze and a temporary binder;

(c) applying a layer of grit particles onto the coating of step (b); and (d) heating the product of step (c) to drive off the binder and attach by brazing said grit particles to said metallic surface layer of said sheet substrate.

58. The method of claim 57 wherein said sheet substrate is a perforated metal sheet.

59. The method of claim 58 wherein said grit material is a diamond grit material.

60. An abrasive sheet comprising: a perforated metal sheet having at least a monolayer of an abrasive grit material brazedly attached thereto.

* * * * *

UNITED STATES PATENT AND TRADEMARK OFFICE

CERTIFICATE OF CORRECTION

PATENT NO. : 5,131,924

DATED : July 21, 1992

INVENTOR(S) : Ronald C. Wiand

It is certified that error appears in the above-identified patent and that said Letters Patent is hereby corrected as shown below:

Column 7, line 60, after "and" insert --was thereafter coated with a braze paste which includes: 80%--

Column 7, line 66, after "torr" insert -- . --

Column 9, line 48, claim 7, "siad" should be --said--

Column 12, line 31, claim 24, "step d" should be --step (d)--

Column 12, line 57, claim 29, "24" should be --28--

Signed and Sealed this

Twenty-fourth Day of August, 1993

Bruce Lehman

*Attest:*

BRUCE LEHMAN

*Attesting Officer*

*Commissioner of Patents and Trademarks*